US012262732B2

(12) United States Patent
Cooper

(10) Patent No.: US 12,262,732 B2
(45) Date of Patent: Apr. 1, 2025

(54) ENHANCED SMOKING PRODUCT

(71) Applicant: Jeffrey T. Cooper, Orlando, FL (US)

(72) Inventor: Jeffrey T. Cooper, Orlando, FL (US)

( * ) Notice: Subject to any disclaimer, the term of this patent is extended or adjusted under 35 U.S.C. 154(b) by 801 days.

(21) Appl. No.: 17/295,283

(22) PCT Filed: Feb. 5, 2020

(86) PCT No.: PCT/US2020/016841
§ 371 (c)(1),
(2) Date: May 19, 2021

(87) PCT Pub. No.: WO2020/163501
PCT Pub. Date: Aug. 13, 2020

(65) Prior Publication Data

US 2022/0000170 A1 Jan. 6, 2022

Related U.S. Application Data

(60) Provisional application No. 62/801,916, filed on Feb. 6, 2019.

(51) Int. Cl.
*A24D 1/02* (2006.01)
*A24D 1/18* (2006.01)

(52) U.S. Cl.
CPC ..... *A24D 1/02* (2013.01); *A24D 1/18* (2013.01)

(58) Field of Classification Search
None
See application file for complete search history.

(56) References Cited

U.S. PATENT DOCUMENTS

2003/0217757 A1* 11/2003 Edelmann ..... A24D 1/02 131/365

* cited by examiner

*Primary Examiner* — Phu H Nguyen
(74) *Attorney, Agent, or Firm* — William Simmons; Simmons Patents

(57) ABSTRACT

A smoking product using splined leaves orientated and configured to achieve a unique cylindrical/tubular structure wherein the splines (e.g., the veins of a leaf structure) are arranged to achieve a burning chamber that creates a non-laminar airflow resulting in an enhanced burning environment.

15 Claims, 7 Drawing Sheets

Sheet Configuration
(Multi Leaf)

SINGLE LEAF CONFIGURATION

Single Strip Configuration
(Multi Leaf)

ENHANCED SMOKING PRODUCT

CLAIM TO PRIORITY

This application claims priority to provisional application 62/801,916, filed on 6 Feb. 2019, of which the entire contents of such document are incorporated herein by this reference for all that the document discloses for all purposes.

TECHNICAL FIELD

A wrapping process, property, configuration, and sequence for finished smoking products using splined leaves, such as cannabis/hemp leaves, that, when orientated and configured properly, achieves a unique cylindrical/tubular structure wherein the splines (e.g., the veins of a leaf structure) are arranged to achieve a burning chamber that creates a non-laminar airflow resulting in an enhanced burning environment.

BACKGROUND OF THE INVENTION

A prior art tobacco cigar is a rolled bundle of dried and fermented tobacco leaves. Almost all prior art cigars are made up of three distinct components: (1) a filler, (2) a binder leaf, and (3) a wrapper leaf. There are many different ways to configure such components that yield correspondingly different types of cigars that use different varieties of tobacco (for example) for the filler and the wrapper, thereby creating a cigar quality ranging from low cost (and low quality) to high cost (premium cigars).

A cigar's outermost layer is called the wrapper and is generally the most expensive component of a cigar. Prior art cigars largely depend on the wrapper quality to give a cigar its character and flavor. Beneath the wrapper is a binder that wraps around a filler (the bulk of a cigar), which is also known as the "rod." When a cigar is lit and smoked, a supersaturated aerosol (smoke) is drawn through the air passageways down the length of a cigar to the smoker.

With the legalization of cannabis (specifically industrial hemp—2018 Farm Bill passed by Congress on Dec. 12, 2018), cannabis-based cigars are becoming increasingly legally viable. For a cannabis-based smoking product, chopped, shredded, or ground cannabis plant parts are rolled in prepared cannabis leaves. While cannabis cigars are similar to prior art cigars in several ways, the cannabis cigar's look is different, its burn rate is different, and the internal aerodynamic properties are different.

Aerodynamics is the science of how air flows around and inside an object. Cigars are configured to allow airflow through the cigar body when being smoked. Thus, the aerodynamics of a cigar configuration can have a material effect on the cigar's quality and the overall smoking experience. For example, a prior art cigar may be said to be rolled too tight when there is insufficient airflow through the cigar when smoked. In contrast, a prior art cigar may be said to be rolled "too loose" when the configuration results in excessive airflow, creating an excessively fast hot burn. Thus, while prior art cigar manufacturers consider the aerodynamics of a cigar's configurations, they have focused their efforts on avoiding the "too tight" or "too loose" conditions and making the wrapper smooth. Prior art cigar manufacturers have failed to leverage aerodynamic properties such as the venturi effect in their designs.

What is needed is a way to consistently and reliably use the natural features of the cannabis leaf to positively influence the aerodynamics of the end product and maximize the smoking experience.

SUMMARY OF THE INVENTION

Some of the objects and advantages of the invention will now be set forth in the following description, while other objects and advantages of the invention may be obvious from the description or may be learned through practice of the invention.

Broadly speaking, a principal object of the present invention is to provide a smoking product that defines a cylindrical elongated body with enhanced aerodynamic properties.

Another object of the invention is to provide a smoking product comprising a binder portion and a wrapper portion, both comprising leaves with splines to define enhanced aerodynamic properties.

Yet another object of the invention is to provide a smoking product where the binder angles and wrapper angles define enhanced aerodynamic resulting properties in an enhanced supersaturated aerosol (i.e., a colloidal suspension of particles dispersed in air or gas produced by the incomplete combustion of a smoking substance; aka "smoke") experience.

Additional objects and advantages of the present invention are outlined in the detailed description herein or will be apparent to those skilled in the art upon reviewing the detailed description. Also, it should be further appreciated that modifications and variations to the specifically illustrated, referenced, and discussed steps or features hereof may be practiced in various uses and embodiments of this invention without departing from the spirit and scope thereof by virtue of the present reference thereto. Such variations may include, but are not limited to, the substitution of equivalent steps, referenced or discussed, and the functional, operational, or positional reversal of various features, steps, parts, or the like. Still, further, it is to be understood that different embodiments, as well as different presently exemplarily embodiments, of this invention, may include various combinations or configurations of presently disclosed features or elements, or their equivalents (including combinations of features or parts or configurations thereof not expressly shown in the figures or stated in the detailed description).

Those of ordinary skill in the art will better appreciate the features and aspects of such embodiments, and others, upon review of the remainder of the specification.

BRIEF DESCRIPTION OF THE DRAWINGS

A full and enabling description of the present subject matter, including the best mode thereof, directed to one of ordinary skill in the art, is set forth in the specification, which makes reference to the appended figures, in which.

Figure 1:
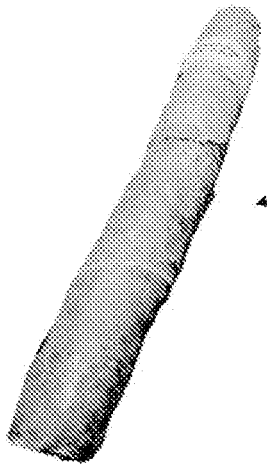
Prior Art Fig. 1
FIG. 1 is a perspective view of a prior art cigar.

Repeated use of reference characters throughout the present specification and appended drawings is intended to represent the same or analogous features or elements of the present technology.

DETAILED DESCRIPTION

Reference now will be made in detail to the embodiments of the invention, one or more examples of which are set forth below. Each example is provided by way of an explanation of the invention, not a limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of the appended claims and their equivalents. Other objects, features, and aspects of the present invention are disclosed in or may be determined from the following detailed description. Repeat use of reference characters is intended to represent the same or analogous features, elements, or steps. It is to be understood by one of ordinary skill in the art that the present discussion is a description of exemplary embodiments only and is not intended as limiting the broader aspects of the present invention.

Construction Aids

For the purposes of this document, unless otherwise stated, the phrase "at least one of A, B, and C" means there is at least one of A, or at least one of B, or at least one of C or any combination thereof (not one of A, and one of B, and one of C).

The term "about" means plus or minus 10% unless stated otherwise. This document includes headers that are used for place markers only. Such headers are not meant to affect the construction of this document, do not in any way relate to the meaning of this document, nor should such headers be used for such purposes.

As used in the claims, the definite article "said" identifies required elements that define the scope of embodiments of the claimed invention, whereas the definite article "the" merely identifies environmental elements that provide context for embodiments of the claimed invention that are not intended to be a limitation of any claim.

While the particulars of the present invention and associated technology may be described for use with cannabis cigars, the disclosed technology may be used for any type of rolled/wrapped smoking product.

Written Description

Before describing the invention, a brief review of prior art smoking devices and the associated aerodynamics and associated burn science should prove helpful.

Referring now more particularly to FIG. 1, one embodiment of a prior art cigar 10 is presented. A prior art cigar 10 defines a generally tubular body comprising three major parts: wrapper, binder, and filler (aka "rod"; the binder may or may not be considered part of the rod) where all parts are composed of smokable material such as tobacco. The wrapper comprises a visible outer cover leaf and is the most expensive component per pound, as these wrapper leaves need to be pristine and smooth in appearance, as well as flavorful. Indeed, in prior art smoking products, the veins of the wrapper leaves are removed to create a smooth appearance. For prior art cigars, for example, if the wrapper leaf is too veiny, rough in texture, or has any blemishes, it's no longer categorized as wrapper leaf.

For prior art cigars 10, the binder (which could be considered a component of the rod) comprises binder-grade tobacco leaves or a "paper" material such as made from processed pulp, directly underneath the wrapper and configured to hold the filler tobacco in place. Combustion of the binder is important as it will enhance the filler burn, especially where the filler contains an oilier smoking substance that does not burn as easily as drier smoking substances.

The filler, which is a component of the rod and may also be referred to as the "rod," defines the center of the prior art cigar and can compose several different types of smoking substances, perhaps from various countries and several different tobacco leaves.

Figure 2:
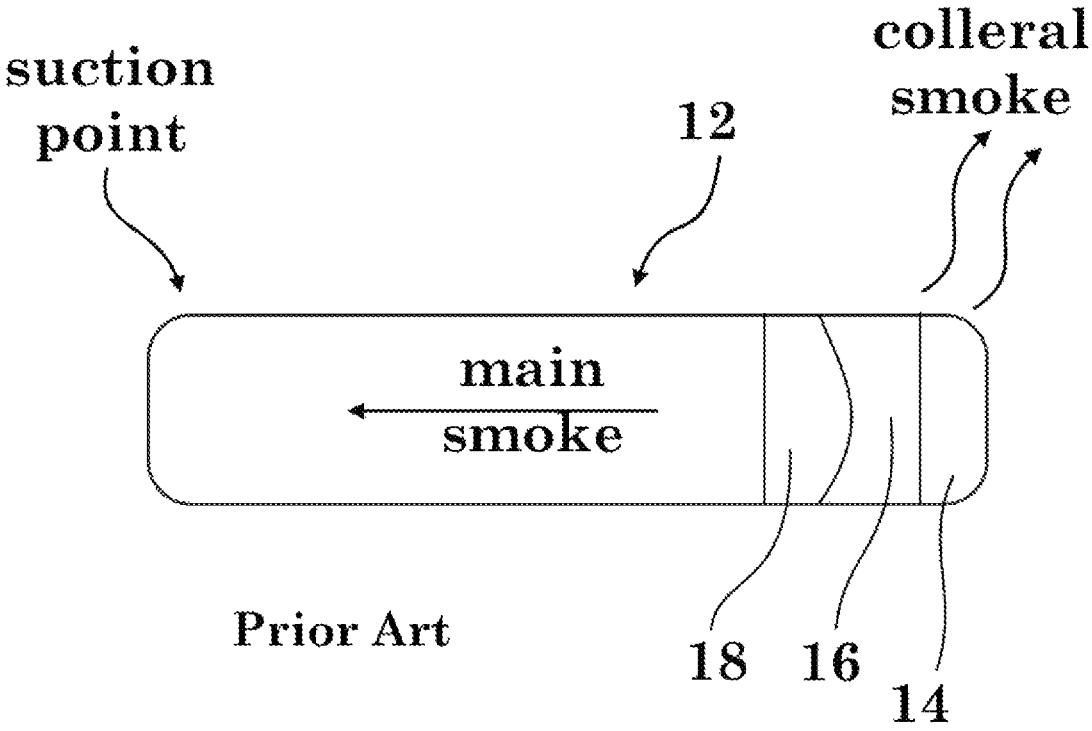
Prior Art Fig. 2
FIG. 2 is a block diagram schematic representation of the combustion science of the smoking product in FIG. 1.

FIG. 2 is a schematic representation of the combustion science of the modern elongated cigar body 12 comprising an ash zone 14, a combustion zone 16, and a distillation zone 18. The "resting" temperature of the coal area (ash area and combustion zone) of a cigar 10 is around 600 degrees Celsius. When suction is applied to the suction point, the temperature of the coal area increases to about 900 degrees Celsius. Such temperature tends to increase the viscosity of the core of the smoking product, causing more airflow around the periphery of the coal, which causes the periphery of the smoking product to experience a more complete burn. The distillation zone 18 experiences oxygen depletion due to combustion, where the high temperatures burn the smoking substance, creating smoke that mixes with a small amount of air drawn in along the rod to produce a stream of supersaturated aerosol (i.e., smoke), which undergoes filtration by the remaining rod and filter (if there is a filter or tip) before reaching the smoker.

The prior art smoking product fails to take full advantage of the wrapper, binder, and filler (rod) aerodynamics to create a more complete burn in the combustion zone 16 as well as create a more atomized aerosol using the aerodynamics of the smoking product's structure.

In contrast to prior art smoking products, the current invention uses a unique smoking product design comprising leaves with splines (veins) (which is particularly well suited for smoking cannabis-based smoking products) in such a way as to achieve a surprisingly better smoking experience. The splines, which can be arranged using a Fibonacci sequence (as described later), create varying pressures and velocities for the air inflow areas around the burning chamber where the splines cause a compression effect where the associated turbulence enhances the burning process of the smoking substance, similar to blowing air on fire to increase airflow for enhanced burning.

Figure 3:
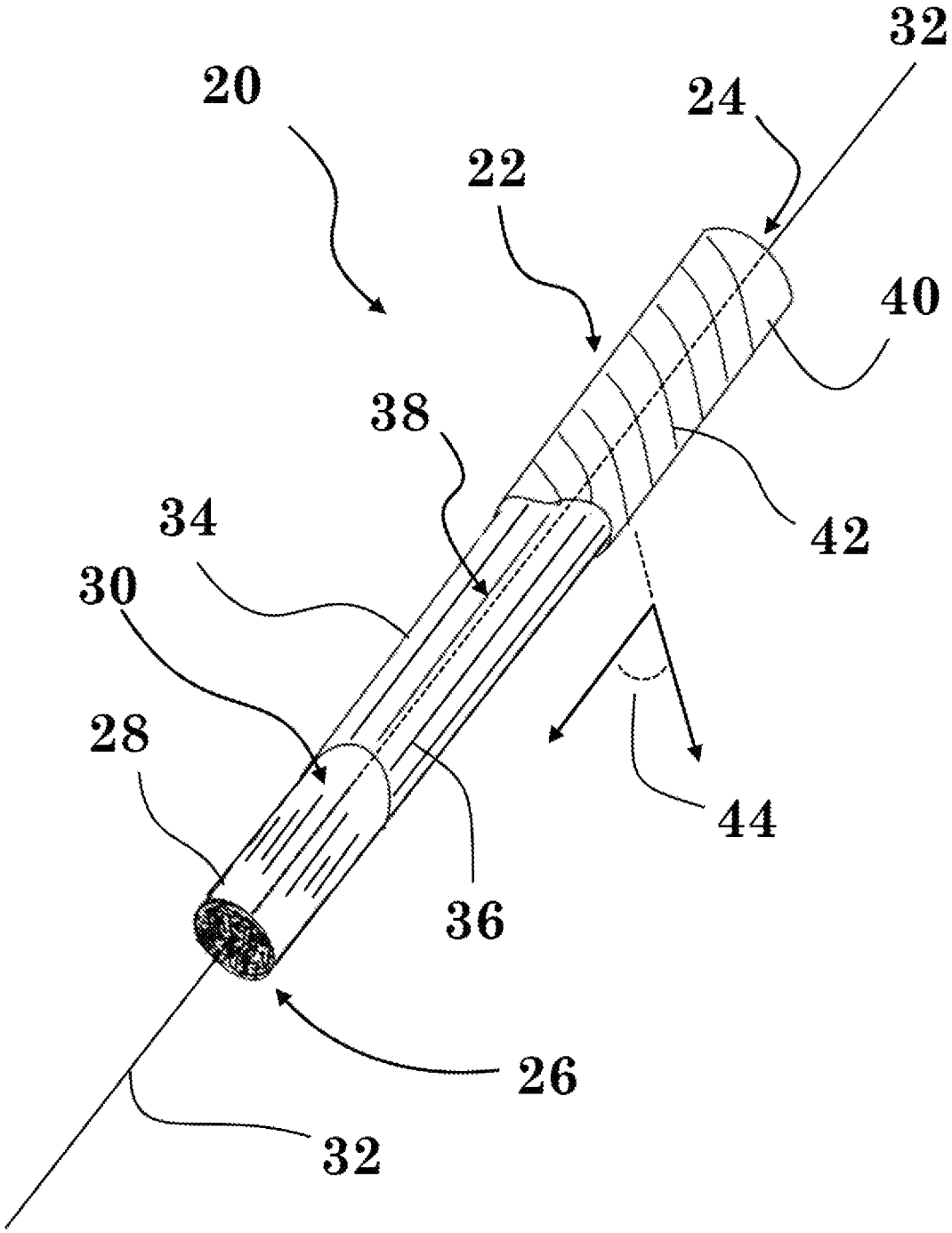
FIG. 3 is a block diagram schematic representation of a smoking product configuration for one exemplary embodiment of the invention.
Figure 4:
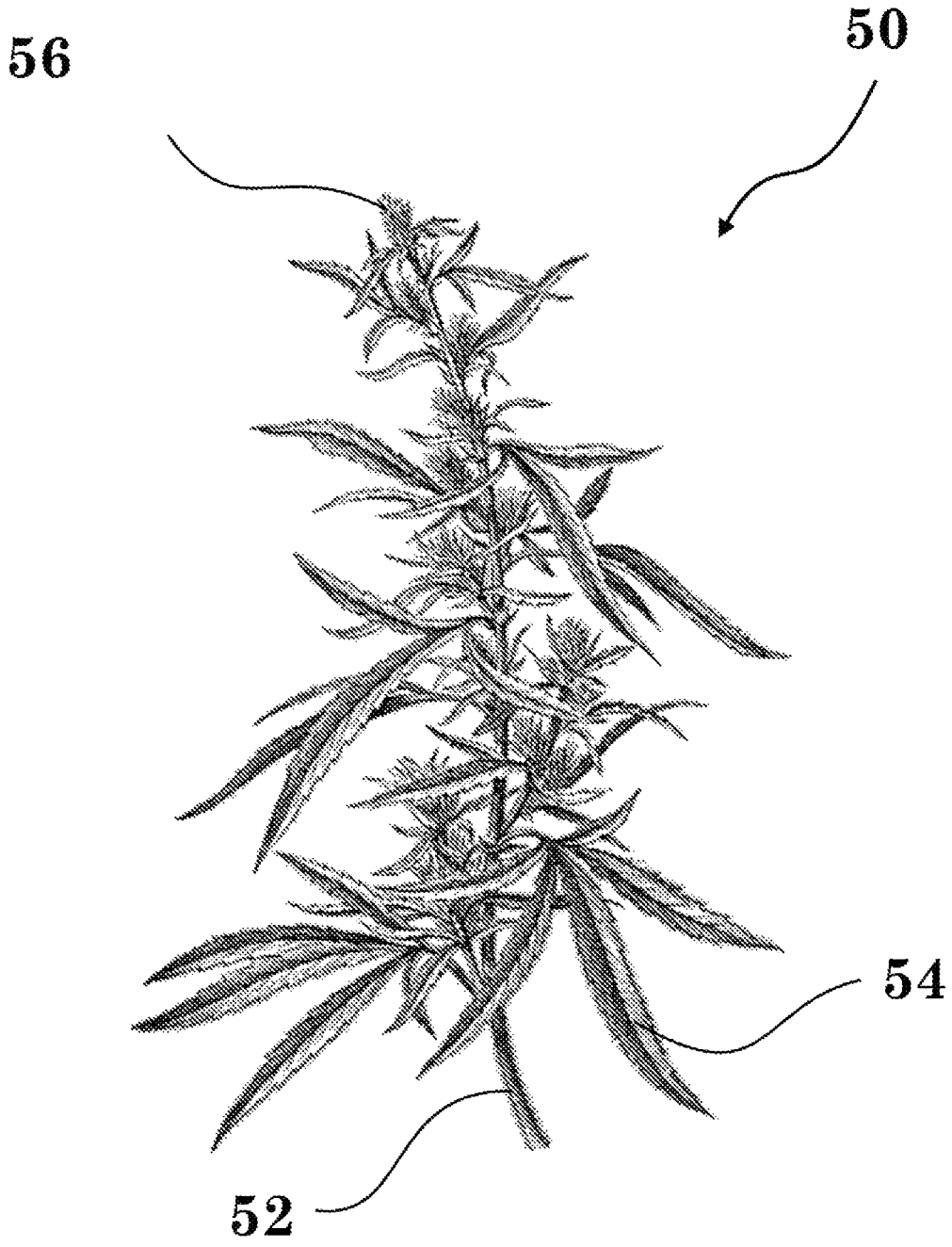
FIG. 4 is a perspective view of an exemplary cannabis plant.

Referring now to FIG. 3, a schematic representation of one exemplary embodiment of a smoking product 20 according to one embodiment of the present invention is presented. It should be appreciated that FIG. 3 is simply a schematic representation of smoking product 20, and the end product may look substantially different. Smoking product 20 defines an elongated body 22 defining a suction end 24 and an opposing combustion end 26 and comprising a filler portion 28 defining a rod element 30 at the center of the elongated body 22 and running the length of the elongated body, thereby defining a longitudinal axis 32. The rod element 30 comprises at least one type of smokable substance, including tobacco, cannabis, Mullein, Skullcap, Coltsfoot, Mugwort, Uva-Ursi, Mint, cloves and Sage.

Smoking product 20 further comprises a binder portion 34 comprising a plurality of binder leaves wherein such binder portion 34 is wrapped around the rod element 30. The binder portion 34 comprises leaves comprising binder splines 36 and is wrapped around the rod element 30 so that each binder spline 36 defines a binder angle 38 relative to the longitudinal axis 32. In FIG. 3, the binder angle 38 is about zero as the splines are in alignment with the longitudinal axis 32. It should be appreciated that a Cannabis leaf has a center spline and side splines. One of ordinary skill in the art will appreciate that, for this description, the "splines" 36 used for leaf alignment are the center splines or veins of a cannabis leaf.

Smoking product 20 further comprises a wrapper portion 40 comprising a plurality of wrapper leaves, with each defining a wrapper spline 42. The wrapper portion 40 is wrapped around the binder portion 34 so that each wrapper spline defines a wrapper angle 44 relative to one of the longitudinal axis 32 or the binder splines 36. The reference point selected is not critical, but from this point, this document will reference the wrapper angle 44 to binder splines 36 unless noted otherwise.

The binder angle 38 can be any angle between 0 and 90 degrees (for the four quadrants totaling 360 degrees). For one embodiment, the binder angle 38 is between about 13 degrees and 89 degrees relative to the longitudinal axis 32 in the counterclockwise direction, looking from the suction end 24 toward the combustion end 26. Similarly, the wrapper angle 44 can be any angle between 0 and 90 degrees. For one embodiment, the wrapper angle 44 is between about 13 degrees and 89 degrees relative to the binder splines 36 in the clockwise direction, looking from the suction end 24 toward the combustion end 26.

It should be appreciated that the direction of wrapping may be reversed from the above example, and the binder wrap and wrapper wrap need not be in opposite directions. For some embodiments, the binder angles need not all be the same, nor do the wrapper angles need to be the same, but for the current embodiment, all binder angles are substantially the same, and all wrapper angles are substantially the same.

Cannabis Leaves

Figure 5:
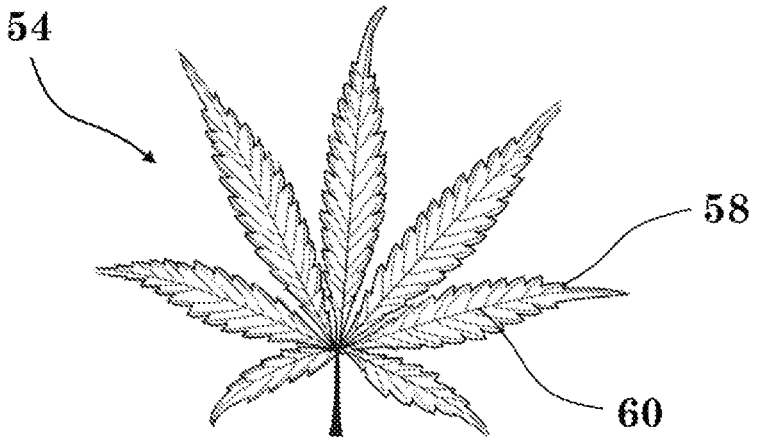
FIG. 5 is a side elevation view of an exemplary cannabis fan leaf.
Figure 6:
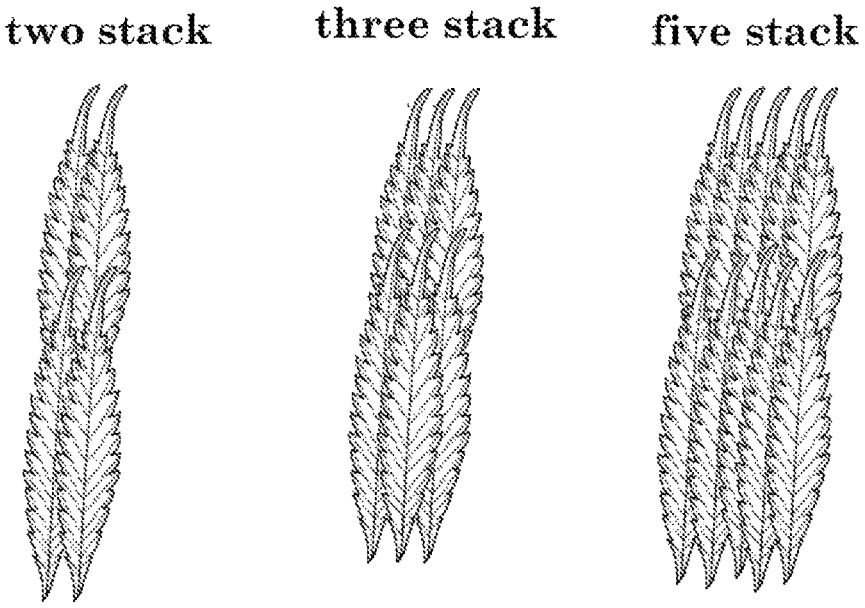
FIG. 6 is a side view of an exemplary stack configuration for individual untrimmed/unprepped cannabis leaves (i.e., natural state) held together by a bonding agent.
Figure 7:
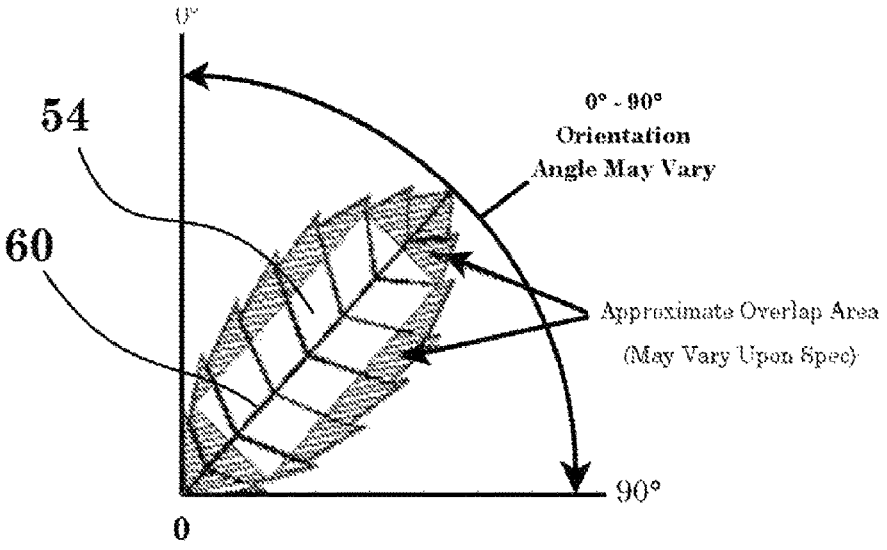
FIG. 7 is an exemplary embodiment of a prepped cannabis leaf (e.g., trimmed)
Figure 8:
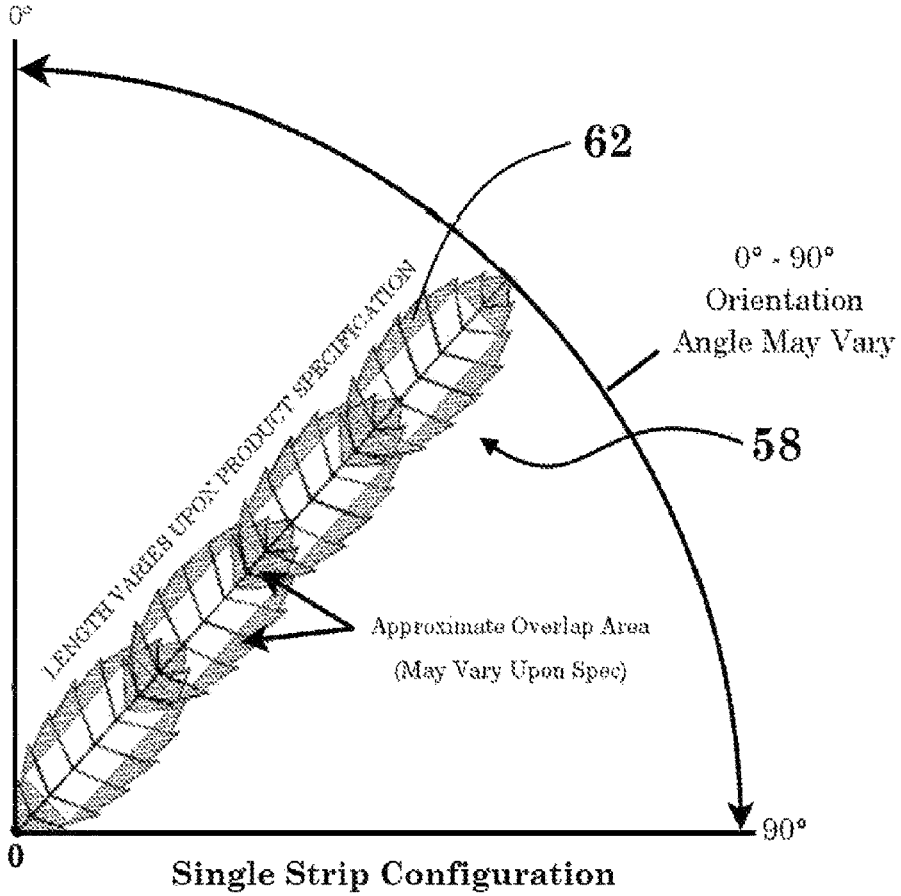
FIG. 8 is an exemplary embodiment of a single stack strip of trimmed cannabis leaves pressed together or held together by a bonding agent.
Figure 9:
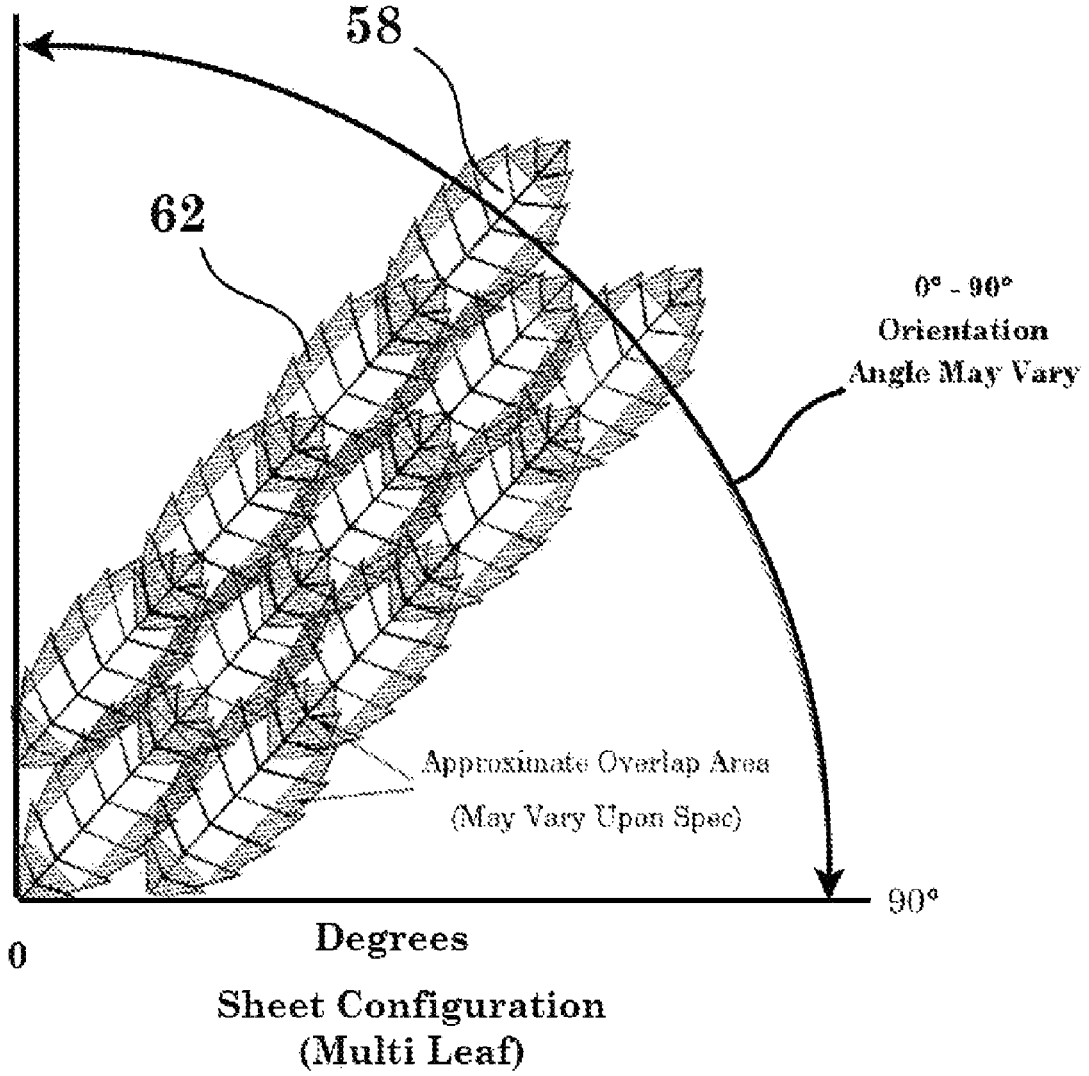
FIG. 9 is an exemplary embodiment of a triple stack strip of trimmed cannabis leaves pressed together or held together by a bonding agent.

For one embodiment, referring to FIG. 4 through FIG. 9, the smoking product 20 is composed of parts of the cannabis plant 50. Generally speaking, the cannabis plant 50 comprises the stem 52, which carries the iconic fan leaves 54 and female flowers (aka "bud") 56 (the male plants do not produce flowers but have the same leaf structural properties). The fan leaves 54, as best seen in FIG. 5, are the big protruding untrimmed leaves 54 appearing along the length of the stem 52 and generally comprise five or seven leaves 58 per fan. Each leaf 58 comprises a "main spline" 60 running along the center of the leaf 58, creating a corresponding ridge running along the center of the leaf 58. Individual leaves 58, as depicted in FIG. 6, are unprepped/untrimmed, and the individual leaves 58 depicted in FIGS. 7 and 8 are prepped/trimmed and may define an overlap area 62.

For the current exemplary embodiment, the individual leaves 58 are used to form the wrapper portion 40 and the binder portion 34, with the higher quality leaf being used for the wrapper portion 40. It should be appreciated that the binder portion 34 may be constructed of a paper product/material (e.g., processed pulp). A single-leaf configuration may be used, as depicted in FIG. 7, or a multi-leaf configuration may be used, as depicted in FIG. 6, FIG. 7, FIG. 8 and FIG. 9, in a stacking configuration. For one embodiment, the stack configurations define a Fibonacci number for reasons described in more detail below.

Combustion Science

Figure 10:
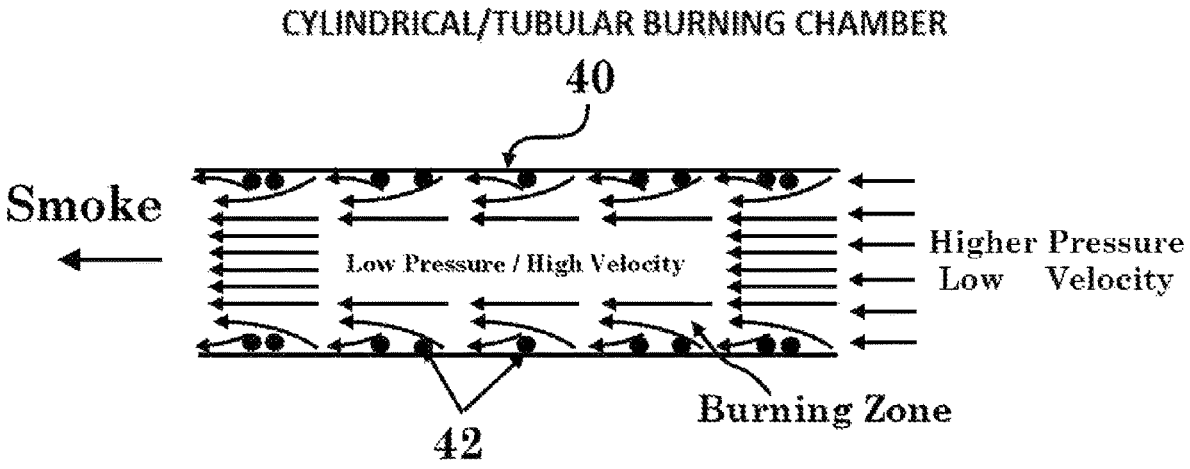
FIG. 10 is a block diagram representation of the combustion properties of an exemplary smoking product.
Figure 11:
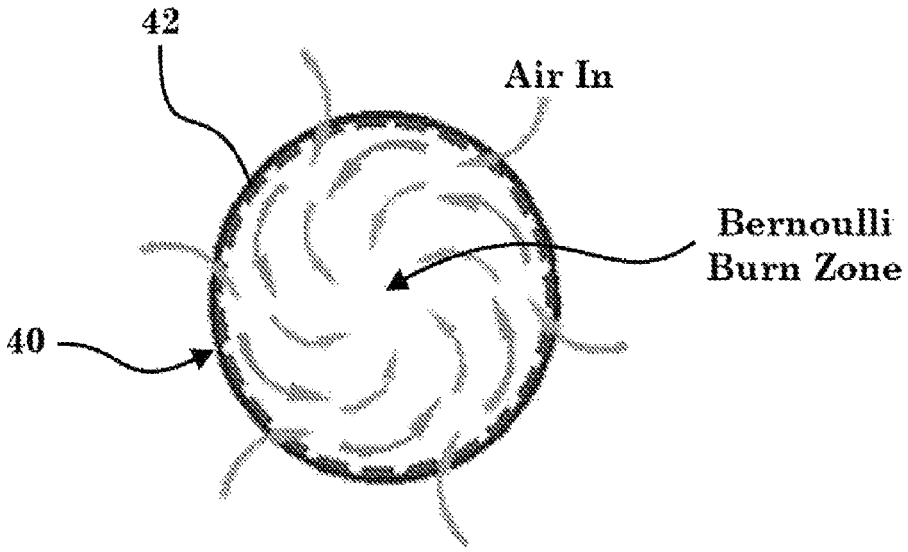
FIG. 11 is a cross-sectional view showing exemplary flow characteristics of an exemplary smoking product.

As noted above, FIG. 2 is a schematic representation of combustion science of the prior art elongated cigar body 12 comprising an ash zone 14, a combustion zone 16, and a distillation zone 18. The basic zones are also present in the smoking product 20; however, as depicted in FIG. 10 and FIG. 11, the wrapper splines 42 and the binder splines 36 are configured to have a desired effect on the combustion and airflow within the elongated body of the smoking product creating a Bernoulli Burn Zone. The splines cause restricted sections within the airflow, where the venturi effect causes pressure and velocity changes. Combined with the angle between the wrapper splines 42 and the binder splines 36, relative to themselves and/or the longitudinal axis 32, a flow vortex may be created, resulting in a hotter combustion temperature for the smoking substance (perhaps cannabis), which results in better atomization, and mixes the resulting supersaturated aerosol (i.e., smoke). The possible combinations of binder angles 38 and wrapper angles 44 and leaf configurations are infinite and could be selected at random. For the current exemplary embodiment, a Fibonacci sequence is used to achieve a predictable and optimized smoking experience.

Fibonacci Sequence

As is well known, the Fibonacci Sequence is a series of numbers found using the following process: Given: F0=0 and F1=1 so that Fn=(Fn−1)+(Fn−2). Such creates a sequence of 0, 1, 1, 2, 3, 5, 8, 13, 21, 34, 55, 89, 144, . . . (i.e., the Fibonacci Sequence). The Fibonacci Sequence is a pattern that appears in nature surprisingly often. The number of pedals on a flower or leaves on a plant stem is often a Fibonacci number.

For the current embodiment, the binder portion 34 is wrapped to create a binder angle 38 of about 34 degrees relative to the longitudinal axis 32 in the counterclockwise direction around the filler rod 28. Similarly, the wrapper portion 40 is wrapped around the binder portion to create a wrapper angle 44 of about 21 degrees, relative to the longitudinal axis 32, in the clockwise direction. Such a configuration creates a 55-degree angle between the binder splines 36, and the wrapper splines 42, yielding a wrapper to binder ratio of 1.618 (55 divided by 34). Any consecutive Fibonacci sequence pair above 13 may be used to set the binder and wrapper angles, yielding the same ratio of 1.618. Such wrapper-to-binder ratio generates optimal burn temperatures and associated mixing of the supersaturated aerosol.

Custom Designer Smoking Products

Since the binder and wrapper angle configurations are infinite, the possible smokable product configurations are correspondingly infinite, in theory. In practice, the number of angles is finite (since one cannot generate infinitely small angles), especially when using Fibonacci numbers between 0 and 360. To generate a custom smoking experience, a customer might wish to design his/her cigar. Thus, a product configuration program may be provided to allow a customer to design his/her smoking product configuration. Such a program could be a desktop-based program or a smartphone application that would allow customers to experiment with their designs and order custom smoking products.

For one embodiment of the designer application, the customer would select one or more smoking substances from a plurality of choices, such as tobacco, cannabis, Mullein, Skullcap, Coltsfoot, Mugwort, Uva-Ursi, Mint, cloves and Sage. The customer would then select the relative percentages of each smoking substance within a predefined set of possibilities. The customer would then select the binder type and, if the binder is to contain a spline, the spline angle and the direction of rotation for the wrap. Next, the customer would select the wrapper type and if the wrapper is to contain a spline, the spline angle, and the direction of rotation for the wrap. It is envisioned that there would be a chain of smoker shops that allow customers to call in or use the application to design their cigars and then travel to the smoking shop to pick up the end product. Alternatively, depending on the current law and laws of the various States, the end product could be shipped to the customer.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should, therefore, not be limited by the above-described embodiment, method, and examples, but by all embodiments and methods within the scope and spirit of the invention as claimed.

What is claimed is:

1. A smoking product defining an elongated body, said smoking product comprising:

a filler portion defining an elongated body defining a longitudinal axis from one end of the elongated body to an opposing end of the elongated body;

a binder portion comprising a plurality of binder leaves with each binder leaf comprising a binder spline and wherein at least half of said binder leaves are wrapped around said rod element so that each said binder spline defines a binder angle relative to said longitudinal axis; and a wrapper portion comprising a plurality of wrapper leaves with each wrapper leaf comprising a wrapper spline and wherein at least half of said plurality of wrapper leave are wrapped around said binder portion so that their respective said wrapper spline defines a wrapper angle relative to a said binder that is a Fibonacci number between 5 and 55 inclusive.

2. The smoking product as in claim 1, wherein said binder angle defines a Fibonacci number between 20-degrees and 60-degrees in the clockwise direction.

3. The smoking product as in claim 1, wherein said wrapper angle defines an angle between 20-degrees and 60-degrees relative to said longitudinal axis in the counterclockwise direction.

4. The smoking product as in claim 2, wherein said binder angle defines about a 21-degree in the clockwise direction relative to said longitudinal axis and wherein said wrapper angle defines about a 34-degree angle in the counterclockwise direction relative to said longitudinal axis.

5. The smoking product as in claim 2, wherein all blinder splines define the same said binder angle and wherein said all wrapper splines define the same said wrapper angle.

6. The smoking product as in claim 1, wherein at least one of said blinder splines and said wrapper splines are wrapped so that the angles between said blinder splines and said wrapper splines Fibonacci sequence.

7. The smoking product as in claim 6, wherein said Fibonacci sequence is 8, 13, 21, 34, and 55.

8. The smoking product as in claim 1, wherein at least one of said binder leaves and said wrapper leaves are cannabis fan leaves.

9. A smoking product defining an elongated body, said smoking product comprising:

a filler portion defining an elongated body defining a longitudinal axis from one end of the elongated body to an opposing end of the elongated body wherein said filler portion comprises a rod element comprising at least one type of smokable product at the center of the elongated body;

a binder portion comprising a plurality of binder leaves wherein each binder leaf defines a binder spline wherein said binder portion is wrapped around said filler portion; and a wrapper portion comprising a plurality of wrapper leaves wherein each defines a wrapper leaf spline wherein each wrapper leaf spline defines a wrapper spline wherein said wrapper portion is wrapped around said binder portion so that each said wrapper spline defines a wrapper angle relative to said binder spline wherein said wrapper angle is a Fibonacci number between 5 and 55 inclusive.

10. The smoking product as in claim 9, wherein said wrapper leaves are wrapped around said binder so that the wrapper angles define a Fibonacci sequence wherein said Fibonacci sequence is 8, 13, and 21.

11. The smoking product as in claim 10, wherein said Fibonacci sequence repeats.

12. The smoking product as in claim 11, wherein said plurality of binder leaves are wrapped around said filler portion so that each said binder spline defines a binder angle relative to said longitudinal axis that is a Fibonacci number between 5 and 55 inclusive.

13. The smoking product as in claim 12, wherein at least half of said binder angles define about a 21-degree angle relative to said longitudinal axis.

14. The smoking product as in claim 13, wherein all blinder splines define the same said binder angle.

15. The smoking product as in claim 14, wherein said binder leaves are wrapped in a Fibonacci sequence wherein said Fibonacci sequence is one of 8, 13, 21, 55, or 13, 21, and 55 or 8, 13, 21.

* * * * *